United States Patent [19]

Simon et al.

[11] 4,209,344

[45] Jun. 24, 1980

[54] DELABELING HOLLOW ARTICLES

[75] Inventors: Joseph F. Simon, Vernon; William D. Wolf, Simsbury, both of Conn.

[73] Assignee: Monsanto Company, St. Louis, Mo.

[21] Appl. No.: 797,432

[22] Filed: May 16, 1977

[51] Int. Cl.[2] ..... B08B 9/00; B08B 7/00

[52] U.S. Cl. ..... 134/23; 134/25 R; 134/33; 134/34

[58] Field of Search ..... 134/29, 30, 120, 1, 134/33, 151, 104, 159, 157, 34, 134, 25 R, 23

[56] References Cited

U.S. PATENT DOCUMENTS

| | | | |
|---|---|---|---|
| 792,010 | 6/1905 | Eick | 134/159 |
| 1,259,743 | 3/1918 | Hunt | 134/120 |
| 2,311,391 | 2/1943 | Herold | 141/7 |
| 2,476,540 | 7/1949 | Fraser | 51/282 |
| 3,302,655 | 2/1967 | Sasaki | 134/134 |
| 3,382,844 | 5/1968 | Kumph | 134/134 |
| 3,487,840 | 1/1970 | Stenzel et al. | 134/153 |
| 3,645,791 | 2/1972 | Sadwith | 134/25 |
| 3,926,666 | 12/1975 | McInnes | 134/33 |
| 3,946,750 | 3/1976 | Fischer et al. | 134/104 |

*Primary Examiner*—Joseph Scovronek
*Assistant Examiner*—Chris Konkol
*Attorney, Agent, or Firm*—Michael J. Murphy

[57] ABSTRACT

A method of removing a label adhesively bonded to the surface of a hollow thermoplastic article disposed in a liquid which comprises effecting vigorous relative movement between the article surface and the liquid.

20 Claims, 6 Drawing Figures

58
22
20
30
28
26
24
95
16
96
32
93
48
44
42
46
12
90
91
18
81
78
80
66
64
72
60
52
38
36
34
40
84
82
88
86

DELABELING HOLLOW ARTICLES

BACKGROUND OF THE INVENTION

This invention relates to delabeling hollow articles and more particularly to a wet delabeling process providing improved completeness of label removal from such articles.

Known wet delabeling techniques involve sequentially advancing labeled articles such as containers in bottle form, through a rather lengthy hot liquid soaking bath at relatively low velocities to soften the bond between label and surface prior to forcible dislodgment by some external means such as by scraping, impingement of a liquid jet or the like. If the thus delabeled articles are intended to be reused without modification of form, washing and sanitizing usually next occur normally within the confines of the same equipment prior to discharge. Practicing these techniques economically at commercially feasible rates is rather demanding if relatively complete label removal from virtually all containers is to occur since residence time in the liquid necessary to sufficiently soften the label-container bond is usually quite substantial, thus dictating the need for equipment of substantial size. This is especialy so with plastic containers wherein the label-securing adhesive may be designed in use to yield to accommodate enlargement or growth of a container, (e.g. under the influence of pressure) in order to avoid fracturing the label. These adhesives are especially tenacious and have been difficult to affect in conventional soaking exposure to a hot liquid in systems of the type described, especially when the label is impervious such as when made of one or more layers of a metal foil material.

SUMMARY OF THE INVENTION

Now, however, process improvements have been developed in delabeling hollow thermoplastic articles which substantially overcome these prior art difficulties.

Accordingly it is a principal object of this invention to provide process improvements applicable to wet systems for removing labels bonded to hollow thermoplastic articles.

Another object is to provide such improvements wherein adhesively bonded labels are substantially completely removed from the surfaces of such articles in the form of lightweight containers such as bottles.

A further object is to provide a cyclic, batch, wet process delabeling system for lightweight thermoplastic containers wherein the time for label removal is reduced.

An additional object is to provide an improved process for simultaneously delabeling, sterilizing and substantially completely removing label adhesive from thermoplastic containers without structurally damaging same.

These and other objects are accomplished in broad terms by providing a method of removing a label adhesively bonded to the surface of a hollow thermoplastic article disposed in a liquid which comprises effecting vigorous relative movement between the article surface and the liquid.

A more specific aspect of the method comprises advancing baffles rotating with a cylindrical delabeling chamber containing a liquid at elevated temperature in a direction circumferential to the longitudinal axis of the chamber into a batch of lightweight thermoplastic containers loosely packed therein and having adhesively secured labels thereon, thereby causing vigorous, tumbling, rubbing contact and intimate soaking exposure to the liquid whereby such labels are loosened and stripped from the container surfaces.

BRIEF DESCRIPTION OF THE DRAWINGS

In describing the overall invention, reference will be made to the accompanying drawings wherein.

DETAILED DESCRIPTION OF THE ILLUSTRATED EMBODIMENT

Figure 1:
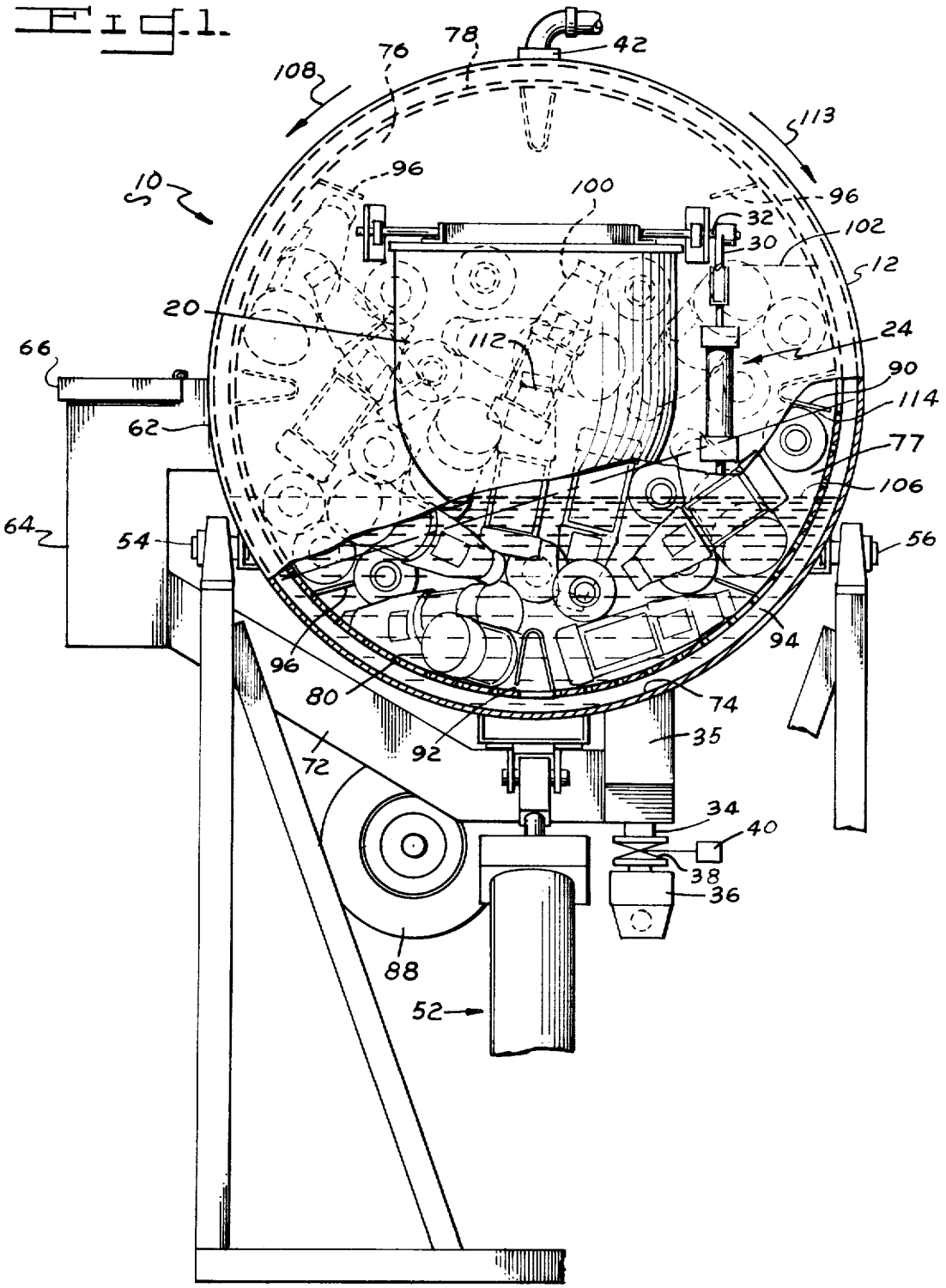
FIG. 1 is a partially schematic, sectional, elevational view of a form of apparatus for use in a process according to the invention shown at the start of the operating cycle just after charging articles thereto.
Figure 2:
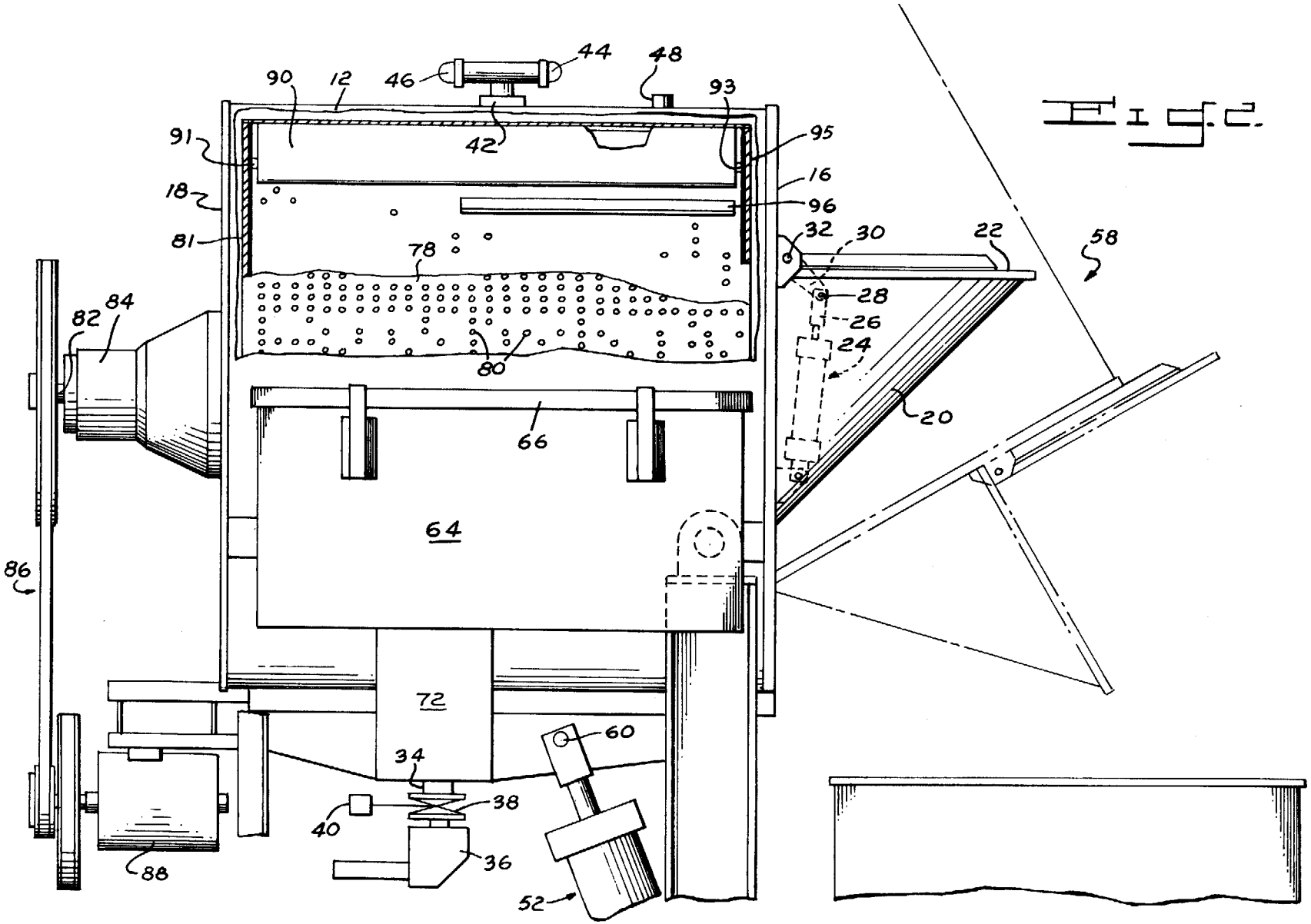
FIG. 2 is a partially schematic side view, partly in section of the apparatus of FIG. 1.
Figure 3:
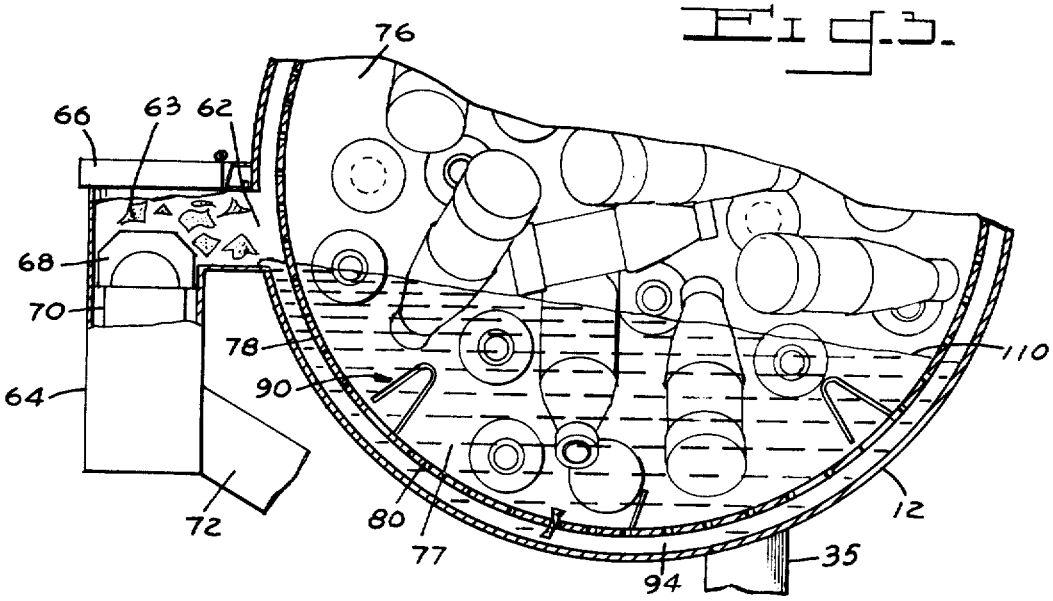
FIG. 3 is a schematic view of a portion of the apparatus during the label removal phase of the process cycle.

Referring now to the drawings, one form of delabeling assembly collectively identified as 10 is illustrated in FIGS. 1–3 and comprises generally cylindrical, shell-like housing 12 having plates 16, 18 on either end (FIG. 2) conventionally mounted for rigid support in a horizontal plane. Chute 20 rigid with plate 16 is in open communication with the interior of housing 12 via a loading entrance in plate 16. Cover 22 is mounted for reciprocal movement toward and away from chute 20, which movement may be automated via conventional linear actuator 24 having extension 26 (FIG. 2) pivotally secured at 28 to an arm 39 rigid with journaled rod 32 fixed to cover 22. Drain outlet 34 (FIGS. 1 and 2) communicates with the interior of housing 12 via overflow return branch 35 and with drain trough 36 through on-off drain valve 38 which may be actuated via remote controlled actuator 40. In this regard, known electronic, mechanical or fluidic cycle time determining components and associated actuating assemblies may be used to sequentially or simultaneously trigger any of the various mechanical components of assembly 10 as the various steps of the process being implemented unfold in a manner to be described. Charge or rinse inlet connection 42 on the upper side of housing 12, communicates via branches 44, 46 and conventional associated piping and valves, not shown, with suitable sources of hot and/or cold water. Similarly, a sanitizing solution charge nozzle 48 associated with conventional piping, not shown, may also be secured to housing 12, generally in a plane through its vertical axis.

A tilt mechanism may be used to periodically move assembly 10 between the solid and the phantom line position 58 in FIG. 2 for loading and unloading. In the illustrated embodiment such mechanism comprises a conventional large size linear actuator 52 pivotally coupled at 60 to a bracket on the underside of housing 12 such that tilting movement of housing 12 about pivot shafts 54, 56 occurs on extension and retraction of the piston rod of actuator 52. Elongated opening 62 on one side along the full length and just below the horizontal centerline of housing 12 opens into overflow chamber 64 rigidly secured to housing 12. Chamber 64 may have cover 66 and brackets removably supporting elongated, generally rectangular overflow basket filter 70 (FIG. 3) which is handled at 68. On the downstream side of filter 70 chamber 64 opens into liquid recycle conduit 72 which in turn communicates via a branch 35 with return opening 74 in the cylindrical wall of housing 12.

Agitating, delabeling chamber 76 concentrically within housing 12 is circumscribed by cylindrical drum 78 which may have patterned, label elimination perforations 80 (FIG. 2) formed in its cylindrical surface to provide a multitude of passageways between chamber 76 and annular space 94 between drum 78 and housing 12. Though preferred in order to facilitate passage of label fragments from chamber 76 to annular space 94, perforations 80 are optional and, except for lengthwise openings 79 to be described, the cylindrical surface of drum 78 could be solid throughout. Solid plate 81 (FIG. 2) closes the rear side of drum 78 and carries drive shaft 82 journaled for rotation in either direction via bearings in housing 84. Rotary power is conventionally transmitted to shaft 82 via intermediate belt drive 86 from a suitable drive mechanism such as motor 88 mounted to a bracket secured to housing 12.

Figure 4:
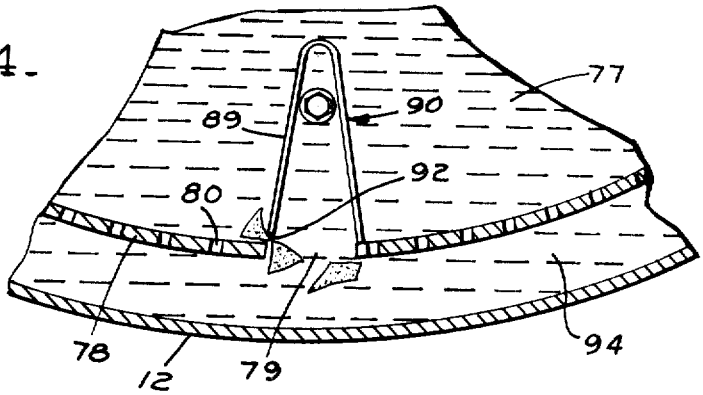
FIG. 4 is an enlarged, schematic view of a portion of the apparatus of FIGS. 1–3.

A series of equi-spaced baffles 90, generally triangular in outline form (FIG. 4), and extending along the full length of drum 78 (FIG. 2) are bolted on one end at 91 to end plate 81 and on the other at 93 to lip 95 fixed on the front end of drum 78. Baffles 90 extend inwardly of the inner surface of drum 78 around the circumference thereof. The portion of drum 78 within the angled sides of each baffle 90 (FIG. 4) is cut away at 79 and, together with long vertically narrow slot passage 92 formed by terminating angular baffle leg 89 just short of the inner surface of drum 78, forms a continuously open label passage between chamber 76 and annular space 94. The vertical height of slot 92 is preferably not too great to facilitate developing a relatively substantial flushing velocity of liquid therethrough in a manner to be described. In the embodiment illustrated, slots 92 are formed at the base and along one side only of each baffle 90 which is on the left when looking in the direction of FIG. 1, such side with respect to housing 12 being the same as that carrying overflow chamber 64. In other words slots 92 are on the leading side of baffles 90 when the latter are moving in direction 113. A series of circumferentially disposed angled skimmers 96 may also be fixed on the inner surface of drum 78 intermediate baffles 90, with the cylindrical surface of drum 78 being slotted adjacent the base of each in the same manner and for the same purposes as previously described slots 92.

In operation, a batch of thin-walled, hollow thermoplastic articles in the form of break-resistant, lightweight, labeled containers illustratively shaped (FIG. 5) as bottles 100 having resilient walls, are charged to chamber 76 within forwardly inclined perforated drum 78 such that after charging the bottles are randomly and loosely packed on top of each other up to about the level indicated at 102 in FIG. 1. The quantity of bottles charged per cycle to chamber 76 should be such as not to exceed a level about comparable to that shown at 102 in the at-rest (FIG. 1) position of the assembly in order to provide sufficient free space to facilitate the desired tumbling movement during the delabeling phase to be described, which movement cannot occur if articles are too tightly packed in the chamber. On the other hand if the number of bottles charged is too few for a given size chamber, there will be insufficient bottle-to-bottle surface contact to achieve relatively complete removal in economically attractive cycle times. The capacity of bottles 100 may be the same as or vary widely one to the other from a nominal liter size which has been successfully used, and preferably encompasses the full range of commercial-size convenience containers of between about 57 to 3600 cubic centimeters. Bottle shape likewise may be of any form in lieu of the cylindrical version of FIG. 5. Labels 104 (FIG. 5) are secured to outer surface portions of the containers with a bonding agent which is preferably heat-softenable and may be a polymeric-based adhesive material. Such labels may be of any conventional material such as, for example, paper, metal foil such as aluminum, plastic, etc. in either laminated or single layer form.

After charging, cover 22 via actuator 24 is closed on chute 20 and the entire assembly 10 tilted rearwardly to the solid line horizontally disposed position of FIG. 2. Next, a liquid medium, which may conveniently be hot water at a temperature of about 49°-66° C., is charged through nozzle 42 to housing 12 and drum 78 until the level reaches approximately 106 (FIG. 1). The amount of liquid charged should not be excessive for a given chamber size in the sense of constituting considerably more than that indicated by level 16 since excess liquid tends to cause a deadening effect in the sense of dampening the important tumbling movement of the bottles to be described.

Next motor 88 is energized to initiate rotation of drum 78 in one direction, for example counter-clockwise as shown by arrow 108 in FIG. 1. The optimum rotary speed of drum 78 is a function of drum diameter and bottle size and may vary within wide limits. The maximum, however, should be less than that at which centrifugal force holds the articles or released label fragments relatively fixed in substantially one place against the inner surface of the drum and preferably should be low enough to promote substantial tumbling action of the bottles over each other, but if too low, agitation will be insufficient. Speeds of between about 15 to 50 rpm, for example 37 rpm, should be used with drum diameters on the order of 37 inches.

During rotary movement of drum 78, the liquid in the system will be displaced to a canted position with respect to the vertical axis of the horizontal drum, the level of which, for counter-clockwise movement 108, is schematically depicted at 114 in FIG. 1. This oblique position is a result of bottles 100 and baffles 90 acting in the nature of paddles, which, in combination with the pumping action of the inner drum surface with respect to the liquid, urges the liquid in the direction of drum movement.

Unidirectional rotary movement of drum 78 causes baffles 90 to continuously advance in such direction, which is circumferential to longitudinal axis 112 of chamber 76, into the batch of bottles 100 and through the liquid pool therein to severly agitate and splash the liquid about the chamber in random manner. Bottles in the path of such baffles and generally adjacent the inner surface of the drum will be raised upwardly away from and in some cases out of the liquid, whereupon as rotation continues any such bottles carried on the baffles will roll off because of gravity back toward the center of the chamber. This vigorous movement of the hot liquid and labeled article surfaces relative to each other causes the liquid in a wedging type of action to work or seep its way under exposed edges of the label to peel it back away from the container surface and expose the adhesive usually located adjacent such edges to the hot liquid. This action is especially important when labels are impervious such as when formed of aluminum foil where the liquid cannot soak through to affect the adhesive as is possible when formed, for example, of paper-based substances. Such wedging action plus the vigorous, tumbling movement, the rubbing engagement of surfaces and the intimate soaking exposure of labels and associated adhesive to the hot water individually and collectively causes loosening of the labels and eventual removal or dislodgement from the article surfaces. For example, rubbing of heel 114 or neck edge 116 of one bottle against the peeled back label edge on an immediately adjacent bottle during such vigorous, assymmetrical, tumbling movement can scrape the already softened label from the container surface. Also, during such action, small, disintegrated label fragments which may be reduced in size as the vigorous action within chamber 76 continues, may exit chamber 76 to space 94 through drum perforations 80.

After a typical period of some 10–20 minutes of this type of action it is possible to terminate the label removal phase of the cycle, drain the liquid and then remove released labels and the delabeled bottles manually from the chamber. To avoid any tendency of the labels to again become attached to the bottles after initial removal, however, it is preferable to provide for label removal from the system as they are being released from the article surfaces. Thus, it is preferred to periodically reverse the direction of drum movement to not only break up any bottle jams within chamber 76 and change the position of each bottle with respect to the others to promote turbulent movement, but also to bring into play the important function of released label removal slots 92. More particularly, with reference to FIG. 1, when drum rotation is reversed to the clockwise direction of arrow 113, liquid pool 77 for reasons previously given assumes the opposite canted position of FIG. 3 wherein 110 represents the level. In assuming such position the forwardmost portion of the liquid pool when considered with respect to direction of movement 113, along with any label fragments floating on or near the liquid surface within space 94 which fragments had previously worked their way into space 94 through perforations 80, will spill over into chamber 64 through housing opening 62. In addition, released labels still within the confines of chamber 76 which had been accumulating below the liquid level adjacent the inner surface of the drum will exit chamber 76 through elongated slots 92 and openings 79 into annular space 94 thereby substantially isolating the bottles and released label fragments from each other. This is a result of slots 92 acting in the nature of successive scoops moving into the label material to flush it through openings 92 and 79. The pumping action of the moving drum then urge label fragments 63 upwardly toward and eventually out through housing opening 62 into filter 70 where such fragments are retained while the filtered water recycles by gravity back into chamber 76 via conduits 72, 35 as schematically illustrated in FIG. 3. Though the delabeling liquid could flow to drain and be continuously replenished, such recycle action as just described minimizes usage and obviates the need for a separately driven pump in the system. Also, isolation of the label fragments in filter 70 minimizes any carryover out the drain line to sewer with the liquid in the latter part of the cycle. After a period of about 10–60 seconds, drum rotation is reversed again and this sequence occurs preferably about 10–50 times during the label removal phase of the cycle.

At the conclusion of such label removal phase and while drum rotation continues, valve 38 is opened to drain the water together with any residual label fragments which had not previously been removed through trough 36 to sewer. Any refuse which might have been present in the bottles at the time of initial charging to the system such as, for example, residual contents, straws, etc. if not caught in filter 70 will likewise be flushed from the system during such draining. In this respect, it should be noted that as the bottles are tumbling about randomly within chamber 76 during removal of labels, the liquid (which may be a cleaning solution) repeatedly enters, splashes or swirls around within and exits the hollow articles. Such liquid movement promotes cleaning of the inner surfaces of the containers contemporaneously with loosening on and released of labels from the outer surfaces. Since the portions of each outer bottle surface previously covered with label a also exposed to the liquid medium after label removal, this means that the entire inner and outer surface of each bottle is subjected to cleaning action during the cycle. It may therefore even be feasible to use the system with articles initially without labels solely for the purpose of obtaining this cleaning action when reuse applications are contemplated.

After removal of the liquid and labels-refuse from the delabeling chamber, drum rotation may be continued for awhile, preferably at a somewhat higher speed than during delabeling, in order to aid in expelling any residual liquid from within the bottles as well as their outer surfaces, thereby promoting drying, such water still exiting the system through open drain 34. During this portion of the cycle fresh rinse water may be charged to the system, the spinning action dispersing the liquid into a spray consistency within chamber 76. Next actuator 52 is energized to tilt the assembly to position 58 by elevating the rear with respect to the front in order to facilitate either manual, gravity or automated unloading of delabeled bottles through chute 20. In the embodiment shown such tilting is sufficient to allow gravity discharge of substantially the entire batch and since the drive system is an integral part of the assembly mounted for tilting movement, drum 78 may optionally continue to be rotated or intermittently jogged during gravity discharge from position 58, thereby dislodging any jammed or entangled bottles and further aiding in ejection from the processing chamber.

As an optional feature, before removing delabeled bottles from the processing chamber and after draining the liquid and discharging dislodged label fragments, a sanitizing solution, for example, liquid caustic at elevated temperature may be charged to the system, whereupon drum rotation and advancing baffle movement is commenced again to cause the same tumbling, intimate washing exposure previously described which can result in sterilizing substantially the entire surface of each container. Such cleansing exposure may be sufficient to adequately sterilize the containers to allow direct refilling with additional contents in reuse applications.

Figure 5:
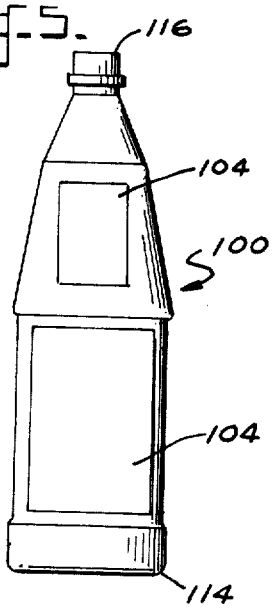
FIGS. 5 and 6 respectively are elevational views of bottles present in the assembly of FIGS. 1–4 before and after label removal.
Figure 6:
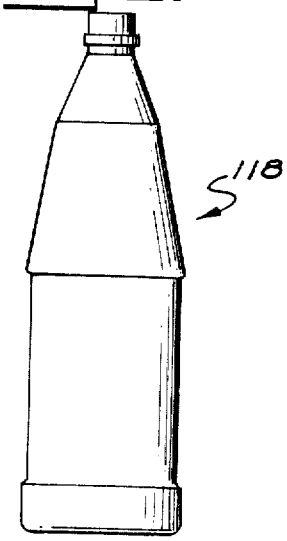

When the bottles are ejected, not only is it found that the labels are substantially completely removed from substantially all the containers in the batch without in any way damaging them, but also the label adhesive is likewise substantially completely removed as a result of the vigorous action of bottles and liquid within the rotating chamber, resulting in a delabeled bottle generally depicted as 118 in FIG. 6. Thus, even though somewhat protectively situated on either side within protruding shoulders on the bottle body as shown in FIGS. 5 and 6, with the process of the present invention labels 104 are nevertheless usually substantially completely removed therefrom.

The above description and particularly the drawings are set forth for purposes of illustration only and are not to be taken in a limited sense. Various modifications and alterations will be readily suggested to persons skilled in the art. For example, the outer housing enclosing the oscillating drum in the embodiment described could be dispensed with entirely and a completely solid drum without any surface openings used alone for delabeling with labels and bottles being manually removed at the end of the cycle. Instead of an arcuate type of oscillating movement of the delabeling chamber to create the turbulence required for label removal according to the invention, other forms of movement may be effectively employed such as for example, back and forth linear translational, continuous or oscillatory eccentric or concentric rotary, vibratory, undulatory and the like, including combinations of same. Likewise delabeling chamber orientation could be vertical or at various planar angles between horizontal and vertical during operation. It is intended, therefore, that the foregoing be considered as exemplary only and that the scope of the invention be ascertained from the following claims.

What is claimed is:

1. A delabeling method which comprises disposing a hollow thermoplastic article having a label adhesively bonded to its surface in a liquid and vigorously moving the article so that relative movement between the article surface and the liquid is obtained.

2. The method of claim 1 wherein the liquid is water at elevated temperature.

3. A delabeling method which comprises tumbling a thermoplastic container having a label bonded thereto about in a moving containment chamber containing a liquid whereby the agitative action between liquid and labeled surface strips the label therefrom.

4. The method of claim 3 wherein a plurality of such containers are present in the moving chamber.

5. The method of claim 3 wherein said chamber movement is rotative.

6. A method of delabeling which comprises advancing baffles rotating with a cylindrical delabeling chamber containing a liquid at elevated temperature in a direction circumferential to the longitudinal axis of said chamber into a batch of lightweight thermoplastic containers randomly, loosely packed therein and having adhesively secured labels thereon, thereby causing vigorous, tumbling, rubbing contact between containers and intimate soaking exposure to the liquid whereby such labels are loosened and stripped from the cntainer surfaces.

7. The method of claim 6 wherein the liquid repeatedly enters and exits the containers during chamber rotation to promote cleaning of inner container surfaces while labels are being removed therefrom.

8. The method of claim 6 wherein said containers are bottles.

9. The method of claim 6 including the steps of removing released labels and draining the liquid from the chamber.

10. The method of claim 6 wherein the adhesive securing the labels to the container surfaces is substantially removed therefrom during tumbling movement within the rotating chamber.

11. The method of claim 6 wherein the rotary speed of the chamber is between about 15 to 50 rpm.

12. The method of claim 9 including before said removing and after said draining the steps of charging a sanitizing solution to the chamber and then commencing said advancing movement of the baffles again whereby the delabeled containers are sterilized by the solution.

13. The method of claim 9 wherein said chamber is situated in a substantially horizontal plane and including the step of tilting the rear of the chamber upwardly after liquid draining to promote gravity dumping from the chamber.

14. In a method of delabeling break-resistant, hollow, thermoplastic articles having surface-bonded labels thereon which involves soaking the labeled surfaces in a liquid to affect the bond, the improvement comprising, in combination, the step of:

tumbling a plurality of such articles together within a moving containment chamber whereby the agitative action between the liquid and the articles dislodges the labels therefrom.

15. The method of claim 14 wherein the articles are containers.

16. The method of claim 14 wherein the labels are made of metal foil.

17. A method of removing labels from lightweight, resilient thermoplastic bottles which comprises:

(a) charging a batch of such bottles having adhesively secured labels thereon to a generally horizontally disposed perforated drum having inwardly directed circumferentially spaced baffles and being mounted for rotation within a fixed housing, such that said labeled bottles are randomly, loosely packed within such drum;

(b) partially filling such housing-enclosed drum with water at elevated temperature;

(c) rotating the drum with the labeled containers therein to repeatedly cause the baffles to (i) move through the water, (ii) raise bottles adjacent the inner drum surface and then (iii) allow them to fall back into the drum as rotation continues, thereby causing vigorous bottle movement whereby rubbing, impacting contact and adhesive-softening exposure to the water strips the labels from the bottle surfaces;

(d) removing the water and released labels from the drum;

(e) continuing rotation of the drum after step (d) to drain water from the bottles within the drum; and then (f) tilting the drum upwardly to promote gravity discharge of the bottles through an exit port in the housing.

18. The method of claim 17 wherein drum movement continues during bottle discharge to aid in bottle ejection therefrom.

19. The method of claim 17 wherein the labels are made of aluminum foil material.

20. The method of claim 7 further comprising;

periodically reversing the direction of baffle rotation without discharging containers from the chamber; and changing the position of containers with respect to each other within the chamber as a result of such rotation reversal.

* * * * *